US008590623B2

(12) United States Patent
Ervin

(10) Patent No.: US 8,590,623 B2
(45) Date of Patent: Nov. 26, 2013

(54) DOWNHOLE TOOLS AND METHODS OF SETTING IN A WELLBORE

(75) Inventor: David L. Ervin, Houston, TX (US)

(73) Assignee: Smith International, Inc., Houston, TX (US)

( * ) Notice: Subject to any disclaimer, the term of this patent is extended or adjusted under 35 U.S.C. 154(b) by 537 days.

(21) Appl. No.: 12/816,934

(22) Filed: Jun. 16, 2010

(65) Prior Publication Data

US 2010/0319934 A1 Dec. 23, 2010

Related U.S. Application Data

(60) Provisional application No. 61/218,764, filed on Jun. 19, 2009.

(51) Int. Cl.
*E21B 34/06* (2006.01)
*E21B 23/01* (2006.01)

(52) U.S. Cl.
USPC ..... 166/317; 166/382

(58) Field of Classification Search
USPC ..... 175/24, 25, 38; 166/382, 317, 319
See application file for complete search history.

(56) References Cited

U.S. PATENT DOCUMENTS

| | | | | |
|---|---|---|---|---|
| 4,474,242 | A * | 10/1984 | Upchurch | 166/323 |
| 4,580,635 | A | 4/1986 | Radford et al. | |
| 4,605,074 | A | 8/1986 | Barfield | |
| 5,443,129 | A | 8/1995 | Bailey et al. | |
| 6,053,250 | A | 4/2000 | Echols | |
| 7,077,212 | B2 * | 7/2006 | Roesner et al. | 166/382 |

OTHER PUBLICATIONS

International Search Report issued in corresponding International Application No. PCT/US2010/039164; Dated Feb. 7, 2011 (3 pages).
Written Opinion issued in corresponding International Application No. PCT/US2010/039164; Dated Feb. 7, 2011 (3 pages).

* cited by examiner

*Primary Examiner* — Brad Harcourt
(74) *Attorney, Agent, or Firm* — Osha Liang LLP

(57) ABSTRACT

A downhole tool disposed in a drillstring includes a bypass valve unit including at least one bypass port, wherein the bypass port is configured to control fluid flow from a central bore of the drillstring to a wellbore annulus, and an activation sub having a frangible obstruction disposed in a central bore thereof and configured to prevent fluid flow to an anchor downhole during a circulation mode, wherein the frangible obstruction is configured to break at a specified fluid pressure in the central bore to allow fluid communication to below.

18 Claims, 2 Drawing Sheets

DOWNHOLE TOOLS AND METHODS OF SETTING IN A WELLBORE

CROSS-REFERENCE TO RELATED APPLICATIONS

This application claims priority to provisional application under 35 U.S.C. §119(e), namely U.S. Patent Application Ser. No. 61/218,764 filed Jun. 19, 2009, which is incorporated by reference in its entirety herein.

BACKGROUND

1. Field of the Disclosure

Embodiments disclosed herein relate generally to downhole tools. More specifically, embodiments disclosed herein relate to hydraulic anchors and methods related to setting hydraulic anchors in a wellbore.

2. Background Art

The drilling industry often has the need to monitor the axial position and angular orientation of a tool (such as a whipstock) within a wellbore, and to rigidly secure the tool within the wellbore once a required position and orientation has been achieved. The position and orientation of a tool may be determined by using measurement-while-drilling tools ("MWD"), which require a flow of wellbore fluid through a drillstring to communicate a measured position and orientation to the surface. The flow rates required for adequate MWD communication may often be sufficiently high to generate a pressure drop between the inside and the outside of the drillstring, which may prematurely set a hydraulic anchor in the wellbore.

To overcome this problem, a drillstring may often include a bypass valve located between the MWD tool and an anchor (located downhole of the MWD tool). When the position and orientation of the drillstring is being monitored, wellbore fluid is pumped through the MWD tool via the bore in the drillstring. The bypass valve prevents the setting of the anchor by allowing the wellbore fluid flowing downhole of the MWD tool to pass out bypass ports and into the wellbore annulus before reaching the anchor. The fluid pressure differential across the hydraulic anchor is thereby maintained below the setting pressure.

Once the drillstring position and orientation is set, the hydraulic anchor may be set by increasing the flow rate of the wellbore fluid down the drillstring. The increase in flow rate causes an increase in dynamic pressure in the bore of the drillstring. When the dynamic pressure increases to a predetermined magnitude, the bypass valve is closed, which eliminates the fluid path between the wellbore annulus and the drillstring bore. Thus, the wellbore fluid is directed downhole to the anchor where the appropriate setting pressure (typically 1500-3000 psi differential between inside and outside of the anchor) is then applied to set the anchor.

A conventional bypass valve incorporates a piston which slides within a cylinder in response to dynamic wellbore fluid pressure. The wall of the cylinder is provided with a plurality of holes (i.e., bypass ports) through which fluid may pass from the drillstring bore to the wellbore annulus. The piston is held in an open position by biasing means, such as a spring or a shear pin, or a combination of both. When the appropriate dynamic pressure is achieved, the biasing means is overcome and the piston slides within the cylinder so as to sealingly close the bypass ports.

This type of bypass valve may be problematic when the wellbore fluid within the drillstring carries a large amount of debris. Such debris may be pumped from the surface, produced by a component failure in the MWD tool, or generated during the drilling of the wellbore. The debris may accumulate on the piston and increase the force exerted on the piston by any given flow rate of wellbore fluid. In certain circumstances, the accumulation of debris may be sufficient to cause the bypass valve to close prematurely. This in turn may cause a premature setting of the hydraulic anchor.

Multi-cycle bypass valves also use a biased piston to remain open. A multi-cycle bypass valve uses a guide pin to control the position of the piston. The piston has a slot for the guide pin travel. The piston will move towards the closed position each time flow is increased and the fluid pressure is sufficient enough to push it downward. The piston will move from an open position to a partially open position in response to pressure. However, the guide pin keeps the piston in a position such that the valve will not close until it has been cycled a predetermined number of times. The position and orientation of the drillstring may continue to be adjusted even though the bypass valve piston has stroked. However, multi-cycle bypass valves are limited themselves, in that the number of cycles is limited, and the guide pins may be unreliable.

Accordingly, there exists a need for a downhole tool that is capable of multiple cycles and that is not susceptible to being prematurely set in the wellbore by a fluid pressure increase.

SUMMARY OF THE DISCLOSURE

In one aspect, embodiments disclosed herein relate to a downhole tool disposed in a drillstring, the downhole tool including a bypass valve unit including at least one bypass port, wherein the bypass port is configured to control fluid flow from a central bore of the drillstring to a wellbore annulus, and an activation sub having a frangible obstruction disposed in a central bore thereof and configured to prevent fluid flow to an anchor downhole during a circulation mode, wherein the frangible obstruction is configured to break at a specified fluid pressure in the central bore to allow fluid communication to below.

In other aspects, embodiments disclosed herein relate to a method of setting an anchor in a wellbore, the method including circulating a fluid from a central bore of a drillstring through a bypass port in a bypass valve unit and into a wellbore annulus, disposing a frangible obstruction in a central bore of a drillstring downhole of the bypass valve unit, wherein the frangible obstruction is configured to prevent the fluid from flowing down the central bore of the drillstring, closing the bypass port, wherein fluid from the central bore is prevented from flowing into the wellbore annulus, and increasing the fluid pressure in the central bore of the drillstring and breaking the frangible obstruction, wherein fluid is allowed to travel down the central bore past the frangible obstruction to the anchor.

Other aspects and advantages of the invention will be apparent from the following description and the appended claims.

DETAILED DESCRIPTION

In one aspect, embodiments disclosed herein relate to a downhole tool having a frangible obstruction disposed therein to control fluid flow down a central bore of the downhole tool prior to setting the anchor in a wellbore. The frangible obstruction allows for control of fluid pressure in the central bore of the downhole tool so that the anchor is not prematurely set in the wellbore by a pressure spike.

Figure 1:
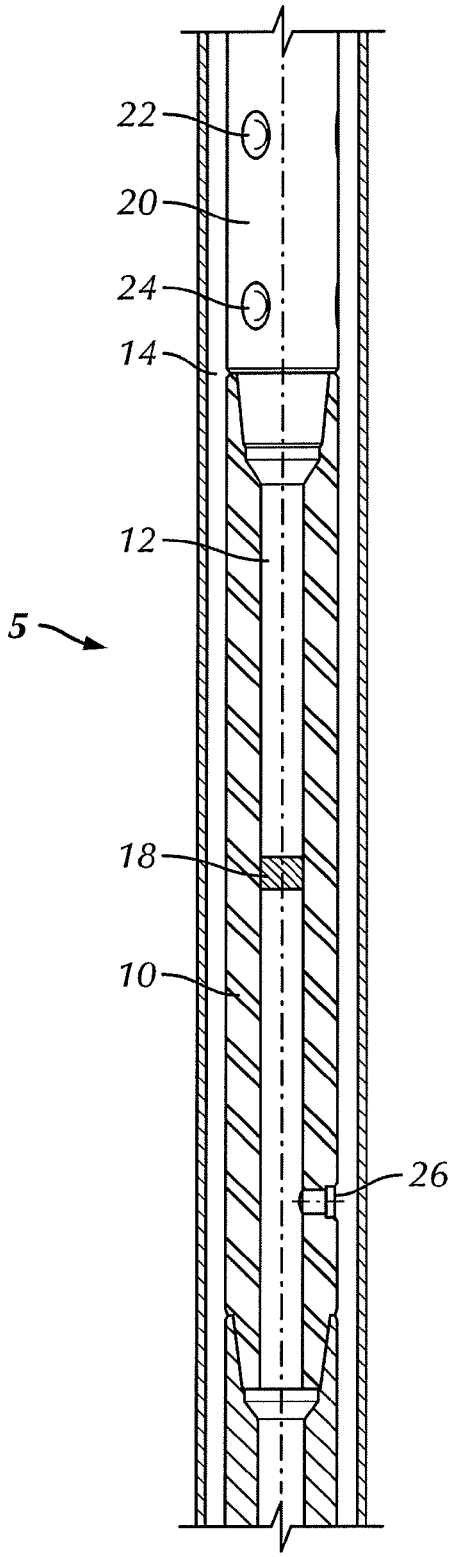
FIG. 1 shows a cross-sectional view of a downhole tool having a bypass valve in a circulation mode in accordance with embodiments of the present disclosure.
Figure 2:
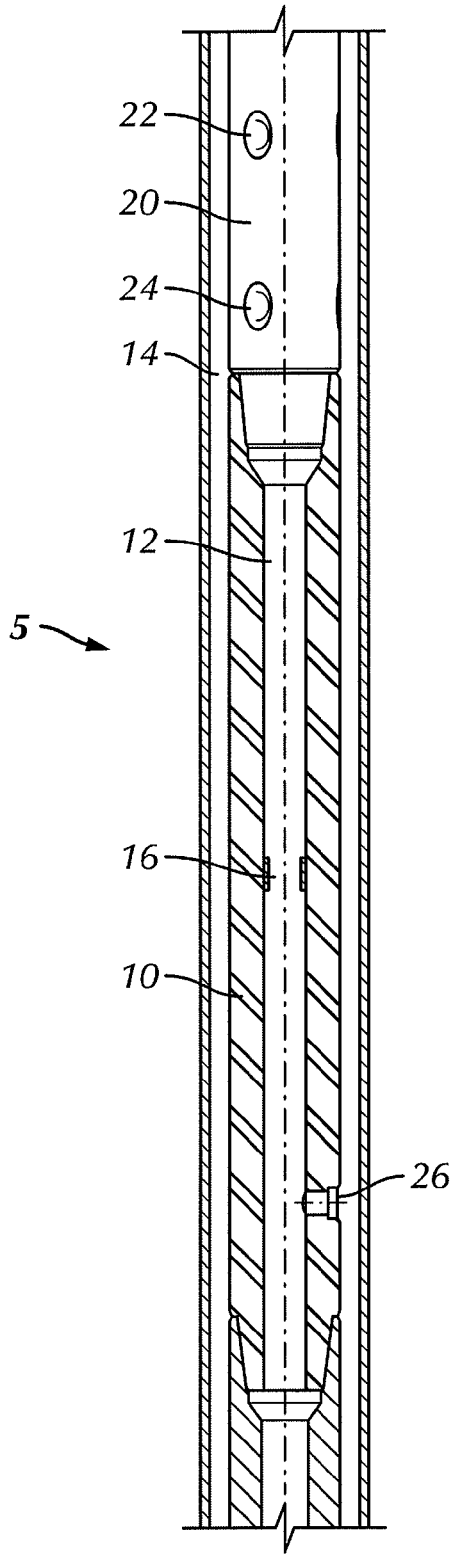
FIG. 2 shows a cross-sectional view of a downhole tool having a bypass valve in a ruptured mode in accordance with embodiments of the present disclosure.

Referring to FIGS. 1 and 2, cross-sectional views of a downhole tool 5 in accordance with embodiments of the present disclosure are shown. The downhole tool 5 is attached to a drillstring (not shown) and includes an activation sub 10, a bypass valve unit 20 attached thereto, and a whipstock with an anchor (not shown) disposed downhole of the activation sub 10. The activation sub 10 is attached to a lower end of the bypass valve unit 20 and a central bore 12 extends through both the activation sub 10 and the bypass valve unit 20. Additional tools and/or components may also be attached in the drillstring above the bypass valve 20, including, but not limited to a MWD tool (or alternatively a gyro), drill collars and drill pipe (none of which are shown). Downhole tool 5 further includes two bleed ports 24, 26, both of which are used to control fluid pressure in central bore 12 when a bypass port 22 is closed, as will be described in full detail below. Bypass port 22 is an aperture located in an outer wall of the bypass valve unit 20, and is configured to allow fluid communication between central bore 12 and a wellbore annulus 14.

Further, as shown in FIG. 1, a frangible obstruction 18 is fixed in central bore 12 of the activation sub 10, which prevents fluid flow down the central bore 12 during a circulation mode. In certain embodiments, the frangible obstruction 18 may be a burst disc. Burst discs are configured to obstruct a bore or channel and resist fluid at a lower pressure, and then fail or burst at a pre-set higher pressure to allow fluid to flow through the previously obstructed channel or bore. In addition, in the circulation mode, bypass ports 22 of the bypass valve unit 20 are open to allow fluid to flow outward from central bore 12 and into the wellbore annulus 14.

Figure 3A:
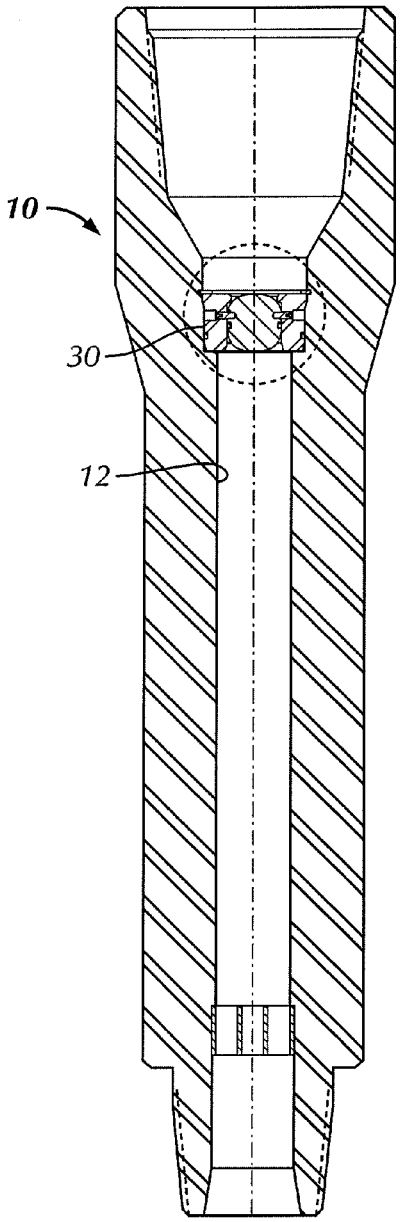
FIGS. 3A-3C show cross-sectional views of an activation sub having a shear out plug disposed therein in accordance with embodiments of the present disclosure.
Figure 3B:
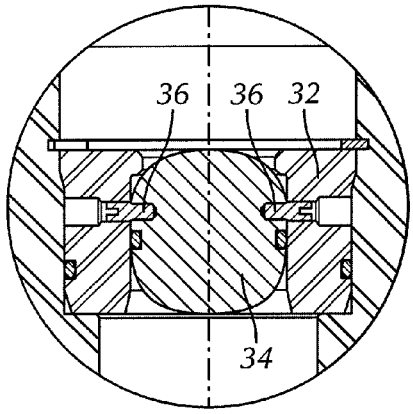
Figure 3C:
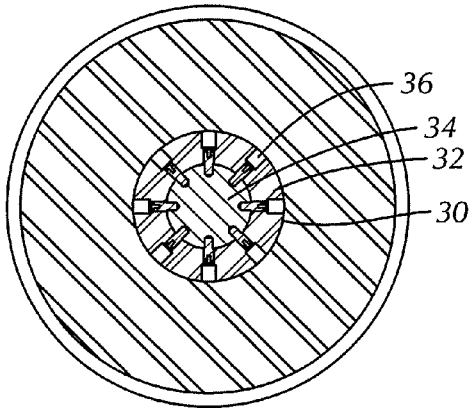

In further embodiments, frangible obstruction 18 may be a shear out plug. Referring briefly to FIGS. 3A-3C, cross-sectional views of an activation sub 10 having a shear out plug 30 in accordance with embodiments of the present disclosure is shown. Shear out plug 30 is disposed in central bore 12 of activation sub 10 to prevent fluid from flowing therethrough. An outer manifold 32 is fixed in the central bore 12, and a plug 34 is removably fixed within the manifold 32 with multiple shear pins 36. When desired, a pressure increase will shear pins 36, and plug 34 is removed from manifold 32 to allow fluid to pass down central bore 12.

Embodiments disclosed herein may incorporate any type of anchor device that is configured to be run into a wellbore with a smaller initial outside diameter that then expands externally to grab or anchor in the wellbore. The anchor may employ flexible, elastomeric elements that expand to engage an inner wall of the wellbore. Those skilled in the art will understand the various types of anchors that may be used, including, but not limited, to production anchors, test anchors, removable anchors, and permanent anchors. Further, those skilled in the art will appreciate that embodiments disclosed herein may be used with downhole packers as well.

Referring back to FIGS. 1 and 2 together, a method of setting the downhole tool 5 in the wellbore is carried out as follows. FIG. 1 shows the downhole tool 5 in a circulation mode. While running the downhole tool 5 into the wellbore in circulation mode, a fluid pressure pumped through central bore 12 for MWD purposes is set to a pressure low enough to ensure that the frangible obstruction 18 is not broken or ruptured (i.e., below a frangible obstruction pressure rating). In certain embodiments, fluid may be circulated at a flow rate of between about 200 gallons per minute (gpm) when the tool is in the circulation mode. In other embodiments, the fluid may be circulated at a flow rate of between about 150 and 250 gpm.

During circulation, in the event that bypass ports 22 are blocked (e.g., forced closed by debris or other obstructions) and pressure in the central bore 12 is increased, a warning is sent to an operator to reduce fluid pressure in the central bore 12 before the frangible obstruction 18 is ruptured. The warning of the increased pressure may be sent in a manner known to those of ordinary skill in the art. An operator may then take remedial action, such as decreasing the circulating fluid pressure to allow the blockage to clear from the bypass ports 22.

FIG. 2 shows a cross-section view of the downhole tool 5 in a ruptured mode in accordance with embodiments of the present disclosure. After a whipstock face (or other tool) is oriented in the wellbore to the correct orientation as measured by the MWD tool, pressure in the wellbore may be increased to set the downhole tool attached in the drillstring (not shown) below the activation sub 10. As understood by those skilled in the art, whipstocks are used to drill a deviated borehole from an existing wellbore. A whipstock has a ramped surface that is set in a predetermined position to guide a drill bit or drillstring in a deviated manner to drill into the side of the borehole, which may also be called a sidetrack window or window. In operation, the whipstock is set on the bottom of the existing borehole, the set position of the whipstock is surveyed, and the whipstock is properly oriented for directing the drillstring in the proper direction.

After orientation of various tools is complete, the flow rate of the circulation fluid is increased above about 200 gpm to close the bypass valve 20. Bypass valve incorporates a piston (not shown) that is configured to slide within the bypass valve unit 20 in response to dynamic wellbore flow rate. At a typical circulation fluid pressure, the piston is held in an open position (e.g., by a spring) in which bypass ports 22 are open to allow fluid to flow therethrough. When the fluid flow rate is increased in the central bore 12, the piston moves axially within the central bore 12 to cover the bypass ports 22 and prevent fluid from flowing therethrough and outward to the wellbore annulus. The piston may be cycled multiple times to open and close the bypass port 22 as desired. When the bypass port 22 is closed, fluid is forced to travel further downhole through central bore 12 toward frangible obstruction 18 (FIG. 1). The bleed port 24 is provided in the activation sub 10 above the frangible obstruction 18 to control fluid pressure in the central bore 12. The bleed port 24 may be configured as a restricted version of the now closed bypass ports 22 (i.e., bleed port 24 has a smaller diameter, which allows a smaller amount of fluid out from central bore 12).

Next, fluid pressure in the central bore 12 is further increased to a pressure (i.e., the preset rupture pressure), at which the frangible obstruction 18 (FIG. 1) breaks (or is ruptured), which allows fluid to flow through the activation sub 10 and down to the anchor (not shown). In certain embodiments, a preset frangible obstruction rupture pressure may be set at between about 2,500 and 3,000 pounds per square inch (psi). When the frangible obstruction 18 is ruptured, fluid may travel downward through the central bore 12 at the rupture pressure and set the anchor downhole.

Advantageously, embodiments of the present disclosure provide a downhole tool that is capable of controlling a fluid pressure in a bore of the drillstring so as not to prematurely set an anchor in the wellbore. Embodiments disclosed herein provide a frangible obstruction located between the bypass valve ports and the whipstock. The frangible obstruction allows for unlimited opened and closed cycles of the bypass ports while in circulation mode. The frangible obstruction is sufficiently strong enough to withstand a pressure differential high enough to warn the surface that the bypass valve has closed. Surface operations can then take remedial action, such as decreasing the flow rate of wellbore fluid, allowing the bypass valve to reopen and resume normal operations. Once the anchor is ready to be set, the bypass valve is closed, and prior to rupturing or breaking the frangible obstruction, bleed ports may be used to further control pressure.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A downhole tool disposed in a drillstring, the downhole tool comprising:

a bypass valve unit comprising at least one bypass port, wherein the bypass port is configured to control fluid flow from a central bore of the drillstring to a wellbore annulus;

an activation sub having a frangible obstruction disposed in a central bore thereof and configured to prevent fluid flow to an anchor downhole during a circulation mode, wherein the frangible obstruction is configured to break at a specified fluid pressure in the central bore to allow fluid communication to below; and a first bleed port located in an outer wall of the bypass valve unit and configured to manage fluid pressure in the central bore after the at least one bypass port is closed.

2. The downhole tool of claim 1, wherein the frangible obstruction is configured to break at between about 2,500 and 3,000 psi.

3. The downhole tool of claim 1, further comprising a measurement-while-drilling tool disposed in the drillstring.

4. The downhole tool of claim 1, wherein the at least one bypass port is closed prior to breaking the frangible obstruction.

5. The downhole tool of claim 1, wherein fluid in the circulation mode circulates at a flow rate of about 200 gallons per minute.

6. The downhole tool of claim 5, wherein the bypass port is configured to cycle in response to an increase in the flow rate.

7. The downhole tool of claim 1, wherein the frangible obstruction is configured to break in response to a pressure increase.

8. The downhole tool of claim 1, wherein the activation sub is disposed downhole of the bypass valve unit.

9. The downhole tool of claim 1, wherein the bypass valve is configured to cycle in response to a circulating fluid flow rate increase.

10. The downhole tool of claim 1, wherein the frangible obstruction comprises a burst disc.

11. The downhole tool of claim 1, wherein the frangible obstruction comprises a shear out plug.

12. A method of setting an anchor in a wellbore, the method comprising:

circulating a fluid from a central bore of a drillstring through a bypass port in a bypass valve unit and into a wellbore annulus;

disposing a frangible obstruction in a central bore of a drillstring downhole of the bypass valve unit, wherein the frangible obstruction is configured to prevent the fluid from flowing down the central bore of the drillstring;

closing the bypass port, wherein fluid from the central bore is prevented from flowing into the wellbore annulus; and increasing the fluid pressure in the central bore of the drillstring and breaking the frangible obstruction, wherein fluid is allowed to travel down the central bore past the frangible obstruction to set the anchor; and controlling the increased fluid pressure in the central bore after closing the bypass port with a first bleed port.

13. The method of claim 12, further comprising increasing the fluid pressure in the central bore of the drillstring to set the anchor in the wellbore.

14. The method of claim 12, further comprising running the downhole tool in the wellbore with a measurement-while-drilling tool.

15. The method of claim 12, further comprising increasing a flow rate of the circulating fluid in the central bore to slide a piston of the bypass valve unit and close the bypass port.

16. The method of claim 12, further comprising breaking the frangible obstruction at between about 2,500 and 3,000 psi.

17. The method of claim 12, wherein the frangible obstruction comprises a burst disc.

18. The method of claim 12, wherein the frangible obstruction comprises a shear out plug.

* * * * *